US006195818B1

(12) United States Patent
Rodstein et al.

(10) Patent No.: US 6,195,818 B1
(45) Date of Patent: Mar. 6, 2001

(54) QUICK CONNECT MOUNTING APPARATUS FOR WATER SPOUT

(76) Inventors: Barbara Rodstein, 10560 Wilshire Blvd. #1106, Los Angeles, CA (US) 90024; Joaquin Serrano, 10427 Washington Ave., South Gate, CA (US) 90280; Ron Bowers, 22649 High Vista La., Apple Valley, CA (US) 92307

( * ) Notice: Subject to any disclaimer, the term of this patent is extended or adjusted under 35 U.S.C. 154(b) by 0 days.

(21) Appl. No.: 09/209,529

(22) Filed: Dec. 11, 1998

Related U.S. Application Data

(60) Provisional application No. 60/107,777, filed on Nov. 9, 1998.

(51) Int. Cl.[7] ..... E03C 1/04
(52) U.S. Cl. ..... 4/678; 137/359
(58) Field of Search ..... 4/675, 676, 677, 4/678; 137/359, 360, 801

(56) References Cited

U.S. PATENT DOCUMENTS

| | | | | |
|---|---|---|---|---|
| 1,562,981 | * | 11/1925 | Muend | 137/360 |
| 2,997,058 | | 8/1961 | Hall | 137/360 |
| 3,136,570 | | 6/1964 | Lee | 137/360 X |
| 3,371,679 | * | 3/1968 | Minella | 137/360 X |
| 3,782,417 | * | 1/1974 | Moen | 137/359 X |
| 4,463,460 | | 8/1984 | Arnold et al. | 137/360 X |
| 4,884,596 | | 12/1989 | Byers et al. | 137/801 |
| 5,950,663 | * | 9/1999 | Bloomfield | 137/359 |

FOREIGN PATENT DOCUMENTS

| | | | | |
|---|---|---|---|---|
| 1932573 | * | 1/1970 | (DE) | 4/678 |
| 3610367 | * | 10/1987 | (DE) | 4/678 |
| 503585 | * | 9/1992 | (EP) | 4/678 |

* cited by examiner

*Primary Examiner*—Robert M. Fetsuga
(74) *Attorney, Agent, or Firm*—Marcia Devon; Chan Law Group

(57) ABSTRACT

An apparatus that provides for the quick and easy installation and removal of Roman Tub Spouts onto a water fitting comprising a water spout, a quick connect member, a trim escutcheon, a hub, a pair of deck nuts and a lock washer. The quick connect member screws into a Tee fitting, or the like, in the plumbing system. The hub screws into the base of the spout and slidably engages the smooth end of the quick connect member. The trim escutcheon is disposed between the spout and hub to provide support to the hub and to conceal the hub while providing decorative ornamentation to the apparatus. Once the spout and trim escutcheon are properly positioned on the quick connect member, a set screw fastens the assembly in place. The deck nuts are positioned above and below the tub surface to hold the apparatus in place on the tub surface.

4 Claims, 4 Drawing Sheets

QUICK CONNECT MOUNTING APPARATUS FOR WATER SPOUT

CROSS-REFERENCE TO RELATED APPLICATIONS

This application claims priority from U.S. provisional application Ser. No. 60/107,777 filed on Nov. 9, 1998, entitled "QUICK CONNECT MOUNTING APPARATUS FOR WATER SPOUT" which is incorporated by reference herein in its entirety.

STATEMENT REGARDING FEDERALLY SPONSORED RESEARCH OR DEVELOPMENT

Not Applicable

BACKGROUND OF THE INVENTION

1. Field of the Invention

This invention pertains generally to bathroom fixtures, and more particularly to an apparatus that provides for the quick and easy attachment and removal of a water spout to a bathtub or sink.

2. Description of the Background Art

Traditionally, water spouts are generally installed onto bathtubs or sinks by screwing or turning the spout over a water fitting or otherwise screwing the fitting onto the spout from beneath the tub. Similarly, to install ornamental spouts, such as "Roman Tub Spouts", the spout must be screwed onto the bathtub or sink prior to installation of the bathtub or sink in its permanent location or screwing the fitting onto the spout from beneath the tub or sink. If there are space, design and/or construction constraints that would prevent the turning or rotation of the spout or fitting in order to attach the spout onto the fitting, the spout installation must be done prior to final installation of the tub or sink in its permanent location. The installation of spouts at such an early stage of construction both renders the spouts susceptible to theft and/or damage to its delicate finish during the completion of construction. Moreover, once the bathtub or sink is set in place and the spout has been installed thereon, removal of the spout becomes impossible without also having to move the bathtub or sink, since accessibility becomes very limited.

Therefore, there exists the need for an apparatus that is reliable and provides for the quick and simple installation and/or removal of water spouts, such as Roman Tub Spouts, without having to turn or screw either the spout or the water fitting. The present invention satisfies these needs, as well as others, and generally overcomes the aforementioned deficiencies.

BRIEF SUMMARY OF THE INVENTION

The present invention is an apparatus that provides for the quick and easy installation and removal of Roman Tub Spouts onto a water fitting. By way of example and not limitation, the apparatus generally comprises a water spout, a quick connect member, a trim escutcheon, a hub, a pair of deck nuts and a lock washer. The quick connect member has tapered threads at one end which screw into a Tee fitting or the like in the plumbing system. The hub slidably engages the smooth end of the quick connect member and includes threads that screw into the base of the spout. The trim escutcheon is generally disposed between the spout and hub to provide support to the spout and also to conceal the hub while providing decorative ornamentation to the overall apparatus.

Once the spout, the hub and trim escutcheon are properly positioned on the quick connect member, a set screw fastens the assembly in place. The deck nuts are positioned above and below the tub surface to hold the apparatus in place on the tub.

An object of the invention is to provide an apparatus that allows for the installation and/or removal of a Roman Tub Spout without the need for turning or screwing the spout over a water fitting.

Another object of the invention is to provide an apparatus that provides for the fast and easy installation and/or removal Roman Tub Spouts.

Another object of the invention is to provide an apparatus for installing Roman Tub Spouts that is reliable and leakproof.

Still another object of the invention is to provide an apparatus for installing Roman Tub Spouts that offers decorative appeal.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 4. It will be appreciated that the apparatus may vary as to configuration and as to details of the parts without departing from the basic concepts as disclosed herein.

Figure 1:
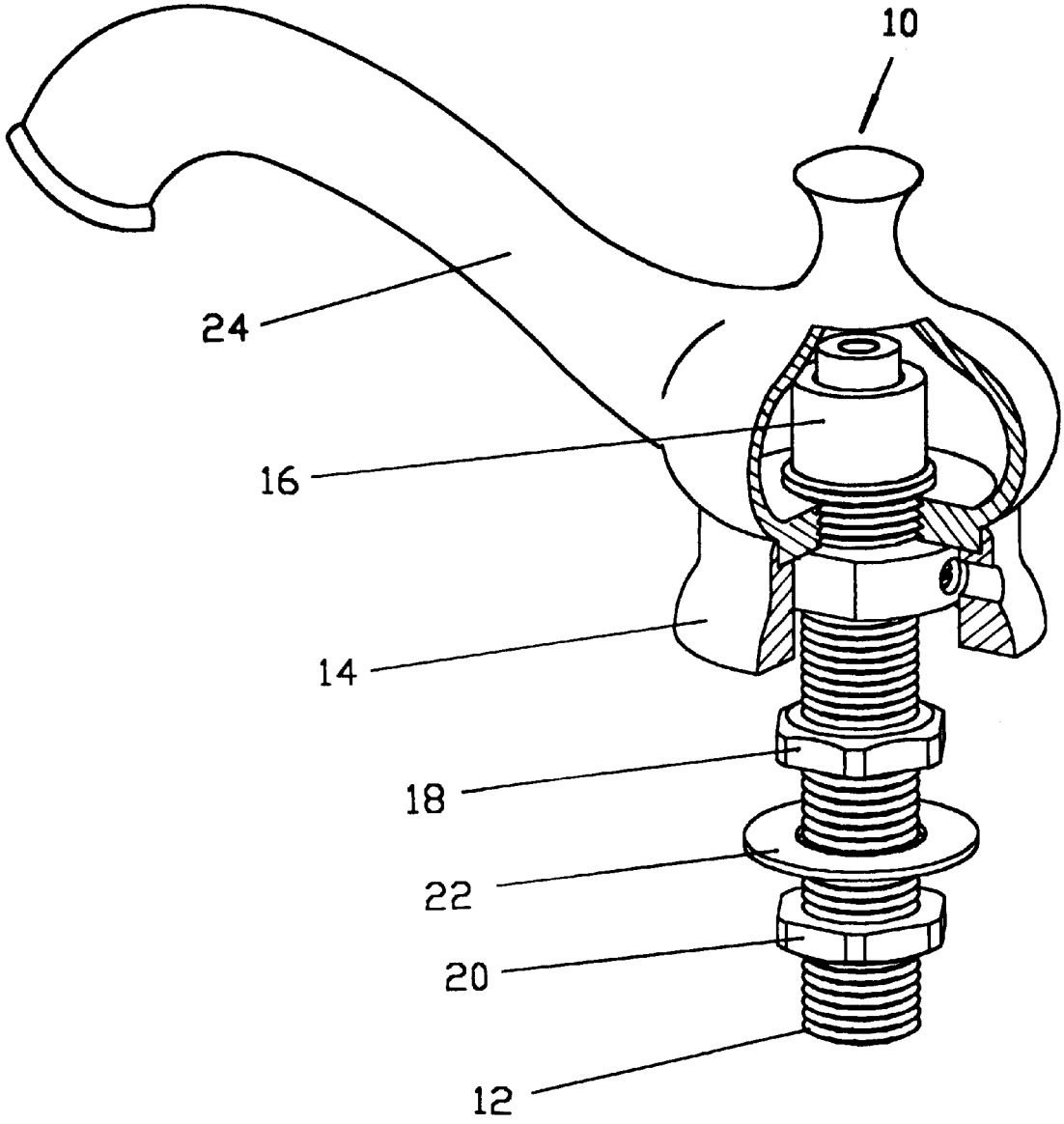
FIG. 1 is a perspective view, partly broken away, of a water spout mounting apparatus in accordance with the present invention.

Referring first to FIG. 1, an apparatus 10 for installing tub spouts in accordance with the present invention is generally shown. Apparatus 10 comprises a quick connect member 12, a trim escutcheon 14, a hub 16, a top deck nut 18, a lower deck lock nut 20, a lock washer 22 and a tub spout 24, such as a Roman Tub Spout or the like. Spout 24 is attached on top of quick connect member 12, which is in turn connected to a water fitting 26, as can be seen in FIG. 3.

Figure 2:
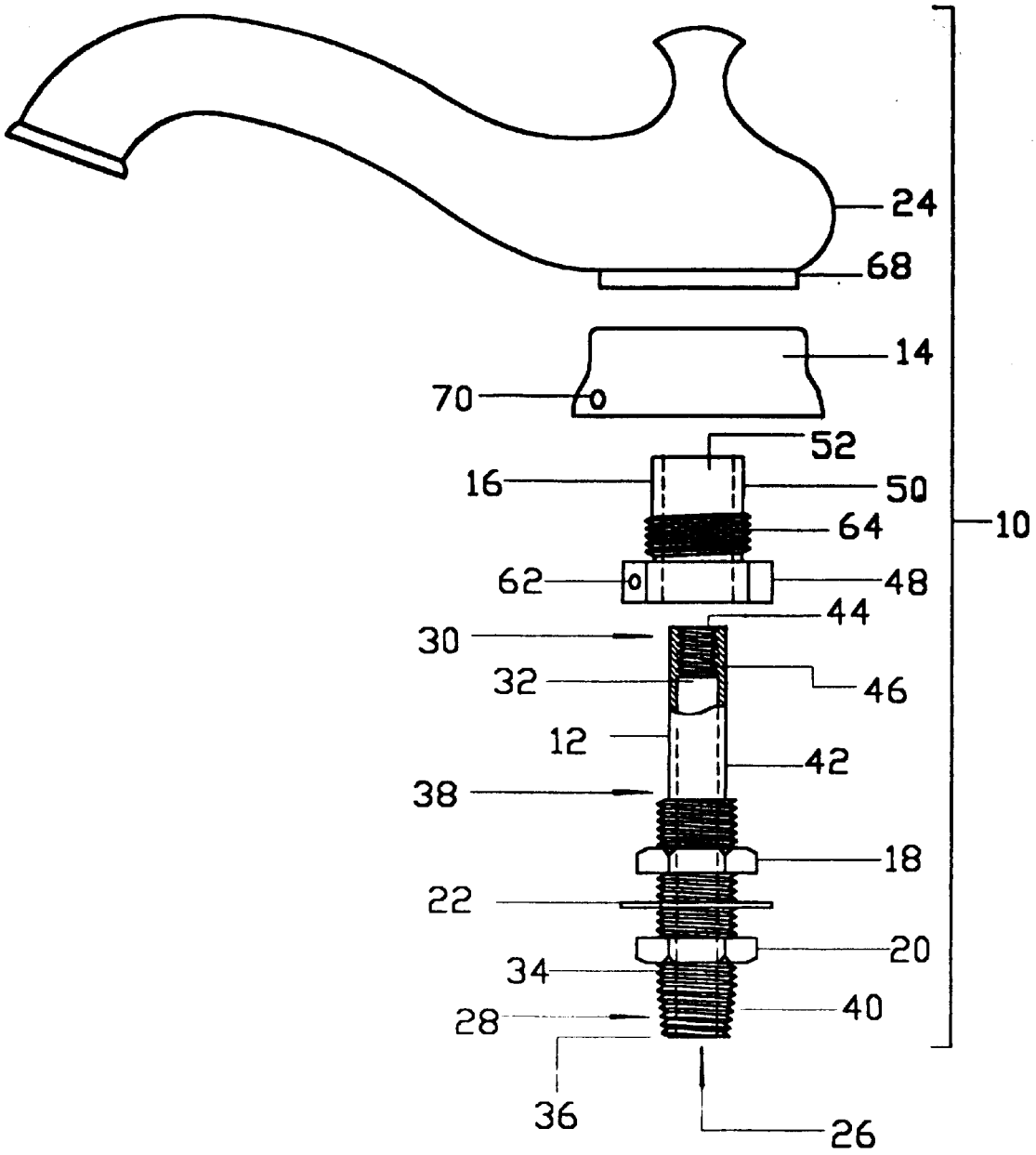
FIG. 2 is a exploded view of a water spout mounting apparatus in accordance with the present invention.
Figure 3:
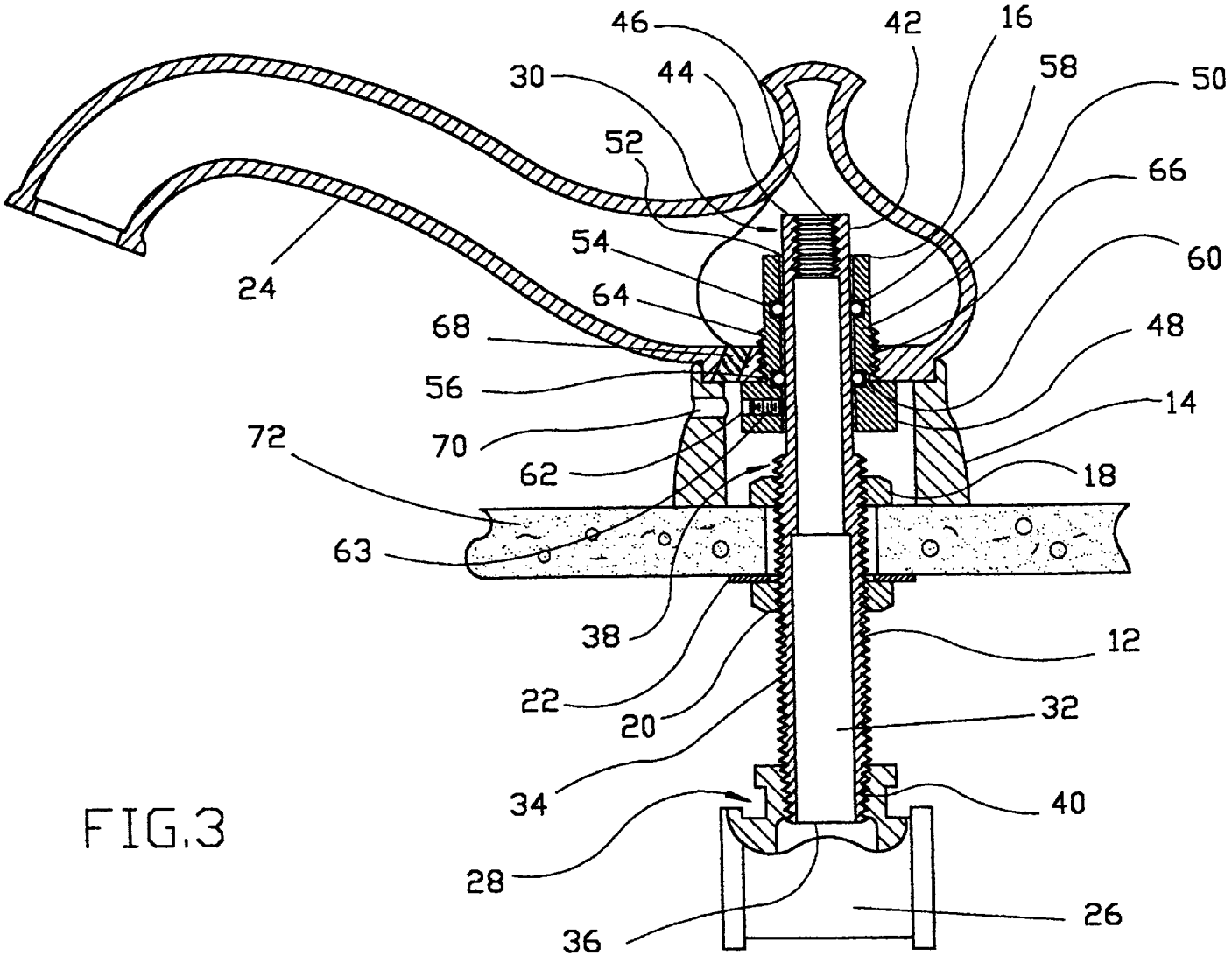
FIG. 3 is a cross-sectional view of a water spout mounting apparatus shown in FIG. 1 attached onto a tub surface.

Referring also to FIG. 2 and FIG. 3, quick connect member 12 includes an inlet end 28, an outlet end 30 and a bore 32 extending therethrough. Inlet end 28 of quick connect member 12 incorporates a threaded section 34 therearound extending longitudinally from the inlet edge 36 towards the mid-section 38 of quick connect member 12. The diameter of threaded section 34 is generally uniform from mid-section 38 towards inlet end 28, and includes a tapered section 40, which tapers downwardly for approximately the final five to seven threads terminating at inlet edge 36. Tapered section 40 is configured to engage internal threads (not shown) within water fitting 26 to form a leakproof connection therebetween. Water fitting 26 is typically a ½-inch or ¾-inch Tee fitting or the like, for supplying water to spout 24.

Outlet end 30 incorporates an elongated nipple 42 that extends from mid-section 38 to outlet edge 44 of quick connect member 12, and elongated nipple 42 has a generally smooth surface and uniform circular outer diameter therealong. Bore 32 is in flow communication between inlet edge 36 and outlet edge 44 of quick connect member 12. Bore 32 has an internally threaded portion 46 adjacent outlet end 30 so that a threaded plug (not shown) may be installed for pressurizing the entire plumbing system for leak testing purposes.

Figure 4:
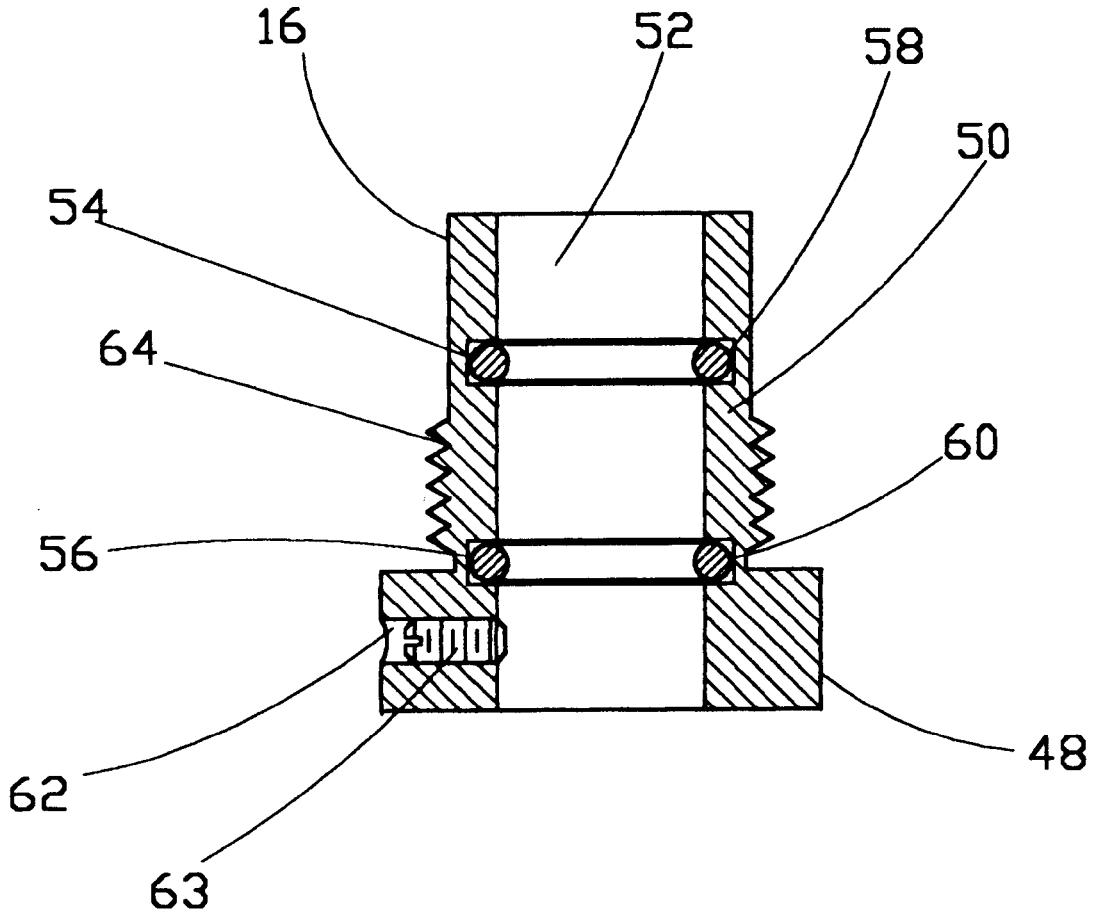
FIG. 4 is a cross-sectional view of a hub shown in FIG. 3.

Referring also to FIG. 4, hub 16 is cylindrically-shaped and includes an annular flange 48, a shank portion 50 and an internal opening 52 extending therethrough. Internal opening 52 is sized to slidably engage elongated nipple 42. There is an upper channel 54 and a lower channel 56 circumferentially disposed within internal opening 52. An upper O-ring 58 and a lower O-ring 60 reside within upper channel 54 and a lower channel 56, respectively, forming a leakproof seal between hub 16 and quick connect member 12 when internal opening 52 of hub 16 is engaged around elongated nipple 42 of quick connect member 12. Flange 48 incorporates a radially-disposed threaded hole 62 adapted to receive a set screw 63 which secures hub 16 on a desired position along elongated nipple 42, thus rendering hub 16 positionally adjustable. Shank portion 50 of hub 16 has external threads 64 that are configured to engage internal threads 66 within the base 68 of spout 24.

Trim escutcheon 14 has an annular shape and is disposed generally between spout 24 and hub 16. Trim escutcheon 14 serves both as a support for spout 24 and to conceal hub 16, while providing decorative ornamentation to apparatus 10. An access hole 70 in trim escutcheon 14 allows for access to the set screw 63. Top deck nut 18 is positioned above the tub surface 72, while lower deck lock nut 20 is positioned below tub surface 72, which is compressed therebetween to hold apparatus 10 in place on the tub. Lock washer 22 is disposed adjacent lower deck lock nut 20 to help prevent lower deck lock nut 20 from loosening. Apparatus 10 is preferably fabricated of brass for superior corrosion resistance and esthetic appeal, though those skilled in the art will appreciate that other substances that provide like or similar characteristics my also be used.

Accordingly, it will be seen that this invention allows for the quick and easy installation and/or removal of a water spout, such as a Roman Tub Spout, from a bathtub or sink while providing a reliable leakproof connection thereon. Although the description above contains many specificities, these should not be construed as limiting the scope of the invention but merely as providing illustrations of some of the presently preferred embodiments of this invention.

What is claimed is:

1. An apparatus connecting a water spout to a water supply fitting, said apparatus comprising:

a hub having a flange, a shank portion protruding from said shank portions, and an internal opening extending throughout said flange and said shank portions;

quick connection means for releasably joining the water spout to the water supply fitting having an inlet end and an outlet end, said quick connection means including a smooth surface which is slidably inserted into said hub, and said quick connection means having a bore which permits fluid flow between said inlet end and said outlet end and;

a top deck nut and a lower deck lock nut wherein said top deck nut and said lower deck lock nut secures said quick connect member to the water supply.

2. The apparatus in claim 1 further including a threaded portion formed on the outlet edge of said quick connect for receiving a threaded plug to seal and pressurize said bore for leak testing.

3. A water spout mounting apparatus of claim 1 further comprising:

a trim escutcheon configured to conceal said hub, said trim escutcheon adapted for placement generally beneath said water spout.

4. A water spout mounting apparatus, comprising:

a quick connect member including an inlet end, said inlet end including threads disposed there around and an outlet end including a generally smooth surface adapted to slidably receive said hub there around, said outlet further including internal threads;

a hub configured to engage said quick connect member including:

a flange, a shank portion protruding from said flange;

an internal opening extending throughout said flange and said shank portion, said internal opening adapted to slidably engage said outlet end of said quick connect member;

a lower channel and an upper channel, said lower channel and said upper channel peripherally disposed within said internal opening a lower O-ring and an upper O-ring and said upper O-ring disposed within said lower channel and said upper channel, wherein said lower O-ring and said upper O-ring provide a watertight seal between said hub and said quick connect member when said hub is engaged around said quick connect member, respectively;

a top deck nut and a lower deck nut, said top deck nut and said lower deck lock nut adapted to secure said quick connect member onto a surface.

* * * * *